US007217248B2

(12) United States Patent
Lin

(10) Patent No.: US 7,217,248 B2
(45) Date of Patent: May 15, 2007

(54) CHAIR

(76) Inventor: Chuan-Shen Lin, No. 21, Sec. 3, Jhangnan Rd., Changhua City, Changhua County (TW) 500

( * ) Notice: Subject to any disclaimer, the term of this patent is extended or adjusted under 35 U.S.C. 154(b) by 86 days.

(21) Appl. No.: 11/035,972

(22) Filed: Jan. 18, 2005

(65) Prior Publication Data

US 2005/0124922 A1 Jun. 9, 2005

Related U.S. Application Data

(63) Continuation-in-part of application No. 10/620,338, filed on Jul. 17, 2003, now abandoned.

(51) Int. Cl.
*A61H 15/00* (2006.01)

(52) U.S. Cl. ..... 601/115; 601/122; 601/126

(58) Field of Classification Search ..... 601/113, 601/115, 116, 118, 122, 146, 126
See application file for complete search history.

(56) References Cited

U.S. PATENT DOCUMENTS 3,764,406 A * 10/1973 Littmann ..... 148/11.1
3,835,844 A * 9/1974 Lang ..... 601/49
4,011,862 A * 3/1977 Kosiak ..... 601/99
4,899,403 A * 2/1990 Yamasaki ..... 5/600
5,251,615 A * 10/1993 Sheen ..... 601/115
6,881,195 B2 * 4/2005 Wu ..... 601/115

* cited by examiner

*Primary Examiner*—Michael A. Brown
(74) *Attorney, Agent, or Firm*—Bacon & Thomas, PLLC

(57) ABSTRACT

This invention relates to a chair, particularly to one provided with a massage device positioned in a seat, backrest, thigh rest or armest. The massage device is composed of a frame and massage roller unit consisting of plural rows of massage rollers fixed in the frame. Two pivotal plates are provided with a center shaft hole for center shaft and two shaft holes respectively for a center shaft and two independent shafts to fit pivotally therein and string each row of the massage rollers. The center shaft is pivotally connected with the inner side of the frame, enabling the massage roller device rotate with the center shaft as a pivot. So when a user rests the body on the massage device, he/she shifts the body to get massage function by the massage surface of the massage roller device.

6 Claims, 15 Drawing Sheets

CHAIR

The present invention is a continuation-in-part of application Ser. No. 10/620,338, filed Jul. 17, 2003 now abandoned.

BACKGROUND OF THE INVENTION

1. Field of the Invention

This invention relates to a chair, particularly to one provided with a simple massage device positioned in a seat, backrest, thigh rest or armrest, having an additional function of massaging to the original function of sitting.

2. Description of the Prior Art

Conventional chairs can be classified into three categories described below.

(1) A first kind of chairs shown in FIG. 1, is a simple chair 1 with a backrest and a seat made of slender bamboo, rattan or soft material, ordinarily used for dining or studying.

(2) A second kind of chairs shown in FIG. 2 is a chair 2 as a sofa made of springs and foam covered with leather for comfortable sitting, and subsequently costing higher.

(3) A third kind of chairs shown in FIG. 3, is a chair 3 like a sofa often seen in guest rooms or waiting rooms in high-class living houses and large hotels, possibly provided with a complicated massage device with a motor for both sitting and massaging, costing very high.

SUMMARY OF THE INVENTION

This invention has been devised to offer a simple chair provided with a simple massage device positioned in a seat, backrest, thigh rest or armrest for two kinds of purposes, sitting and massaging, with not so high cost.

The feature of the invention is a massage device combined in a seat, backrest, thigh rest or armrest, with a frame chamber formed in the seat, backrest, or thigh rest for receiving the massage device, which is composed of a frame and a massage roller unit arranged in stringed rows in the frame. Then the massage device forms massage surfaces for a user to sit, lie or rest on, and the user can shift the body on the massage roller unit so as to get massaged by the massage rollers contacting and rotating against the user's body.

BRIEF DESCRIPTION OF DRAWINGS

This invention will be better understood by referring to the accompanying drawings, wherein.

DETAILED DESCRIPTION OF THE REFERRED EMBODIMENTS

Figure 1:
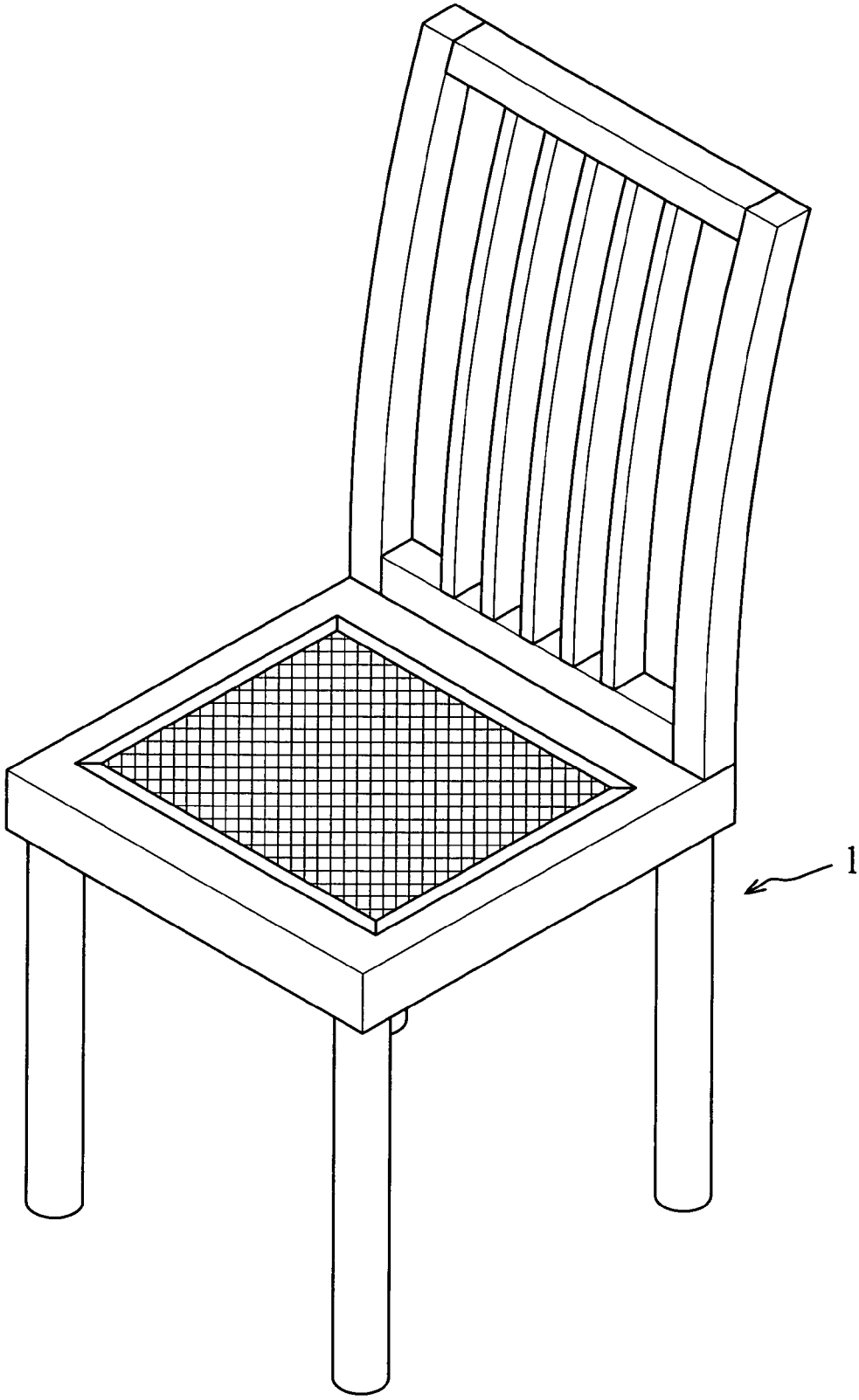
FIG. 1 (PRIOR ART)
FIG. 1 is a perspective view of a first conventional chair.
Figure 2:
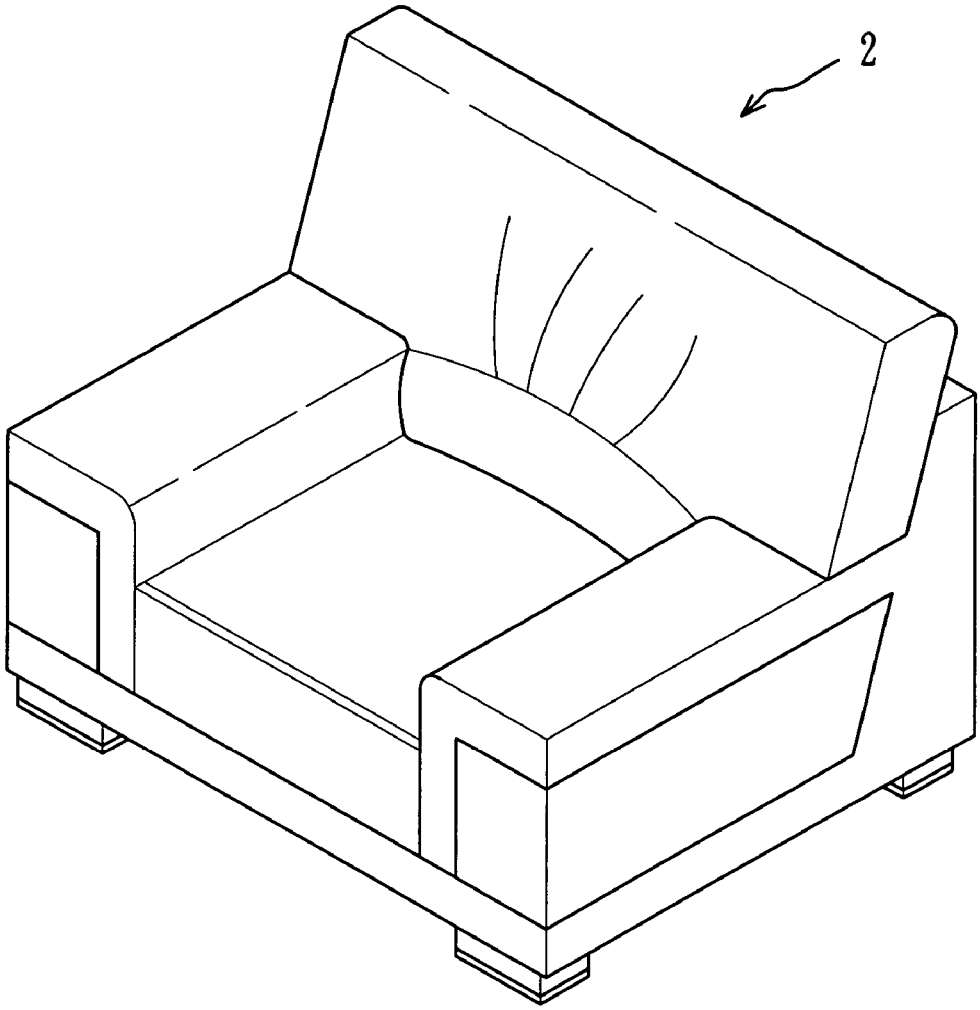
FIG. 2 (PRIOR ART)
FIG. 2 is a perspective view of a second conventional chair.
Figure 3:
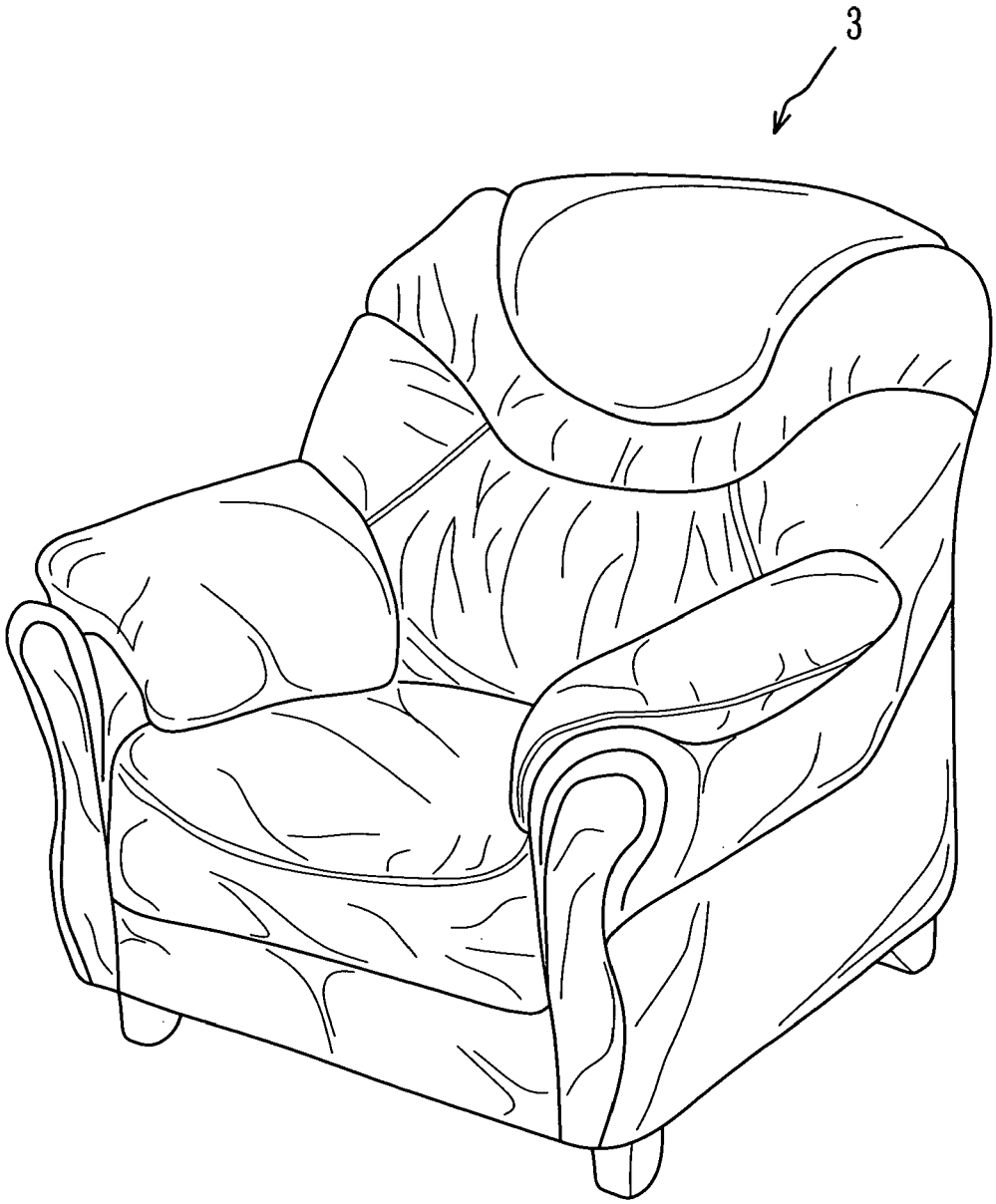
FIG. 3 (PRIOR ART)
FIG. 3 is a perspective view of a third conventional chair.
Figure 4:
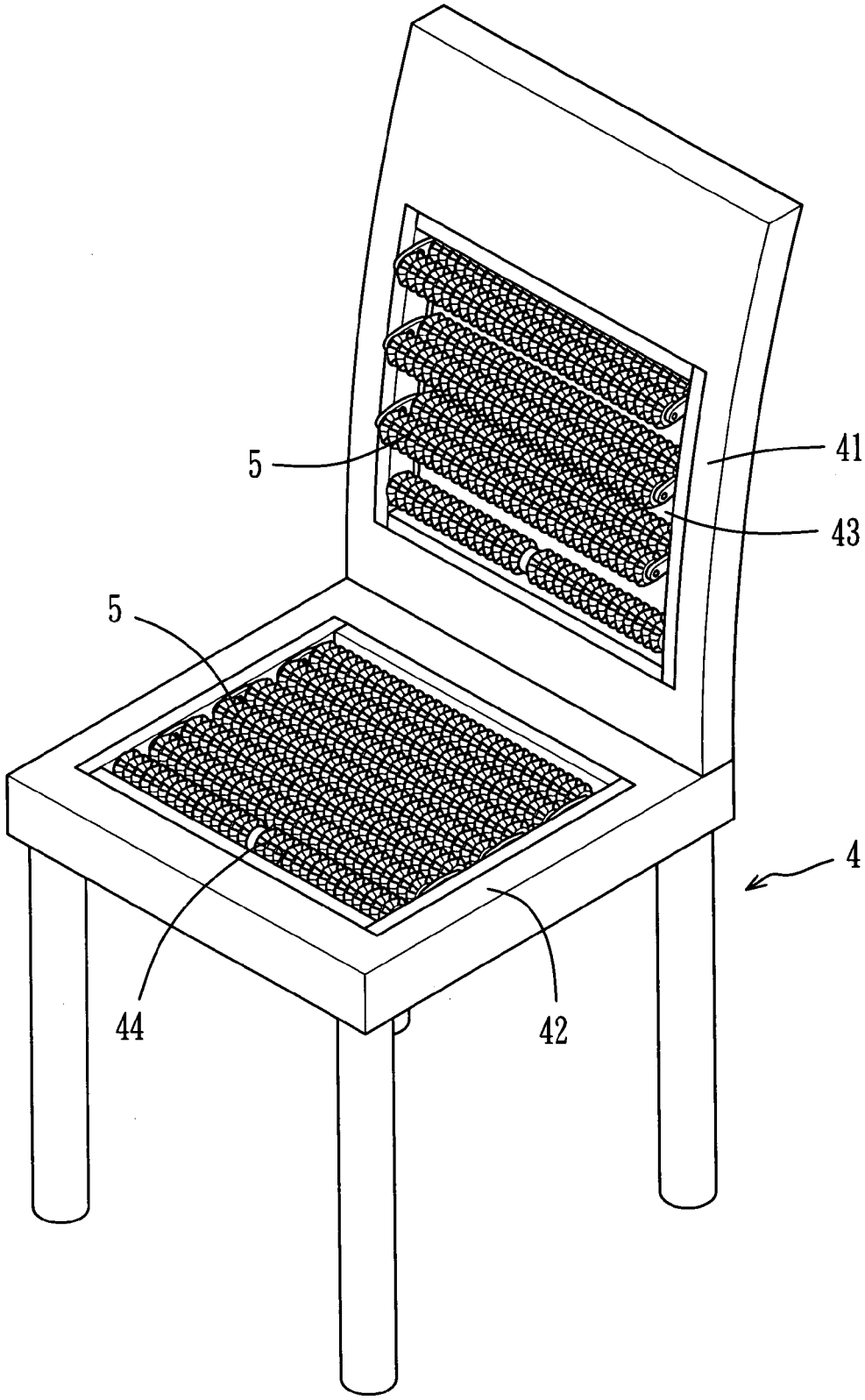
FIG. 4 is a perspective view of a first embodiment of a chair in the present invention.
Figure 5:
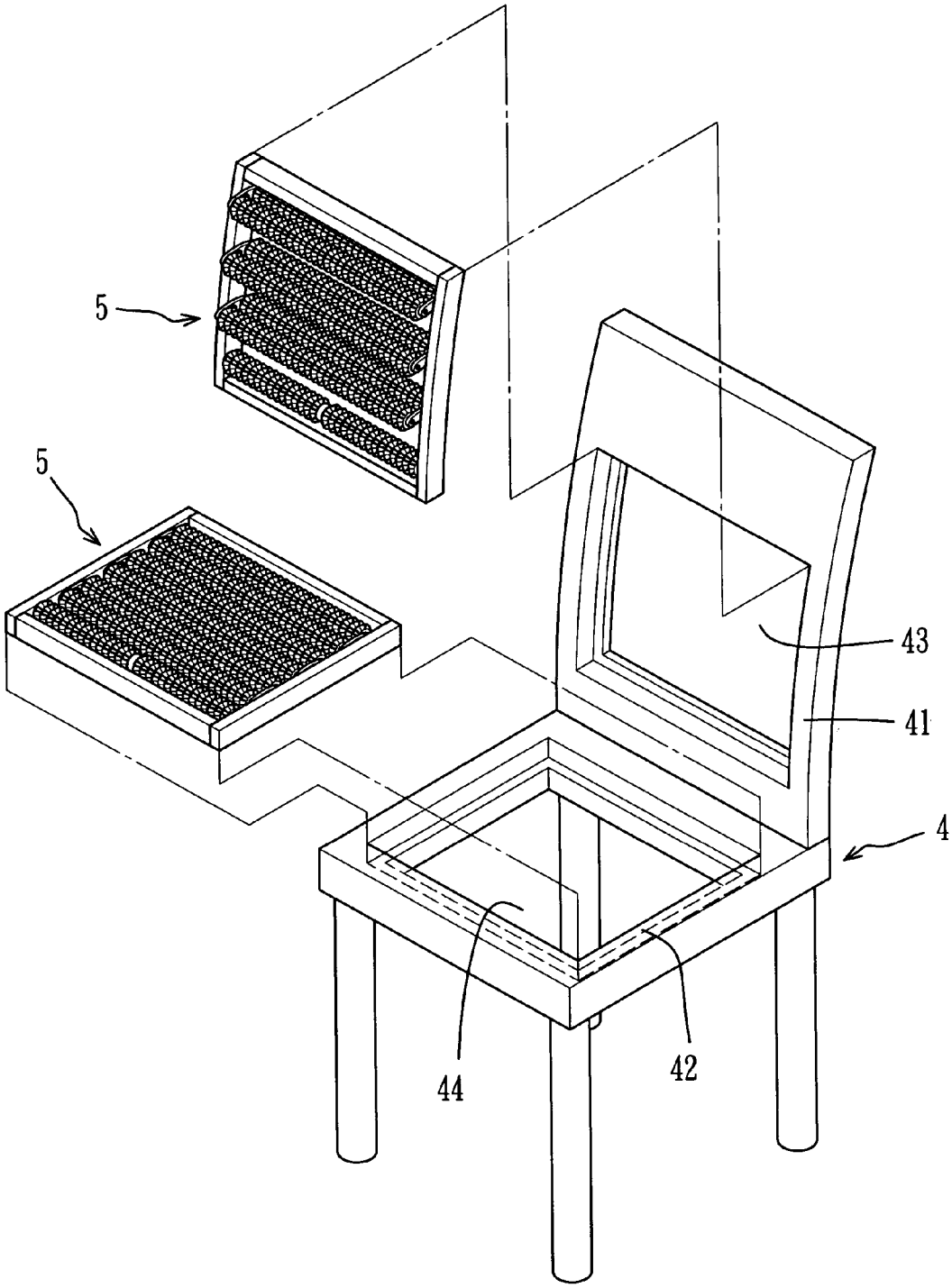
FIG. 5 is an exploded perspective view of the first embodiment of a chair in the present invention.
Figure 6:
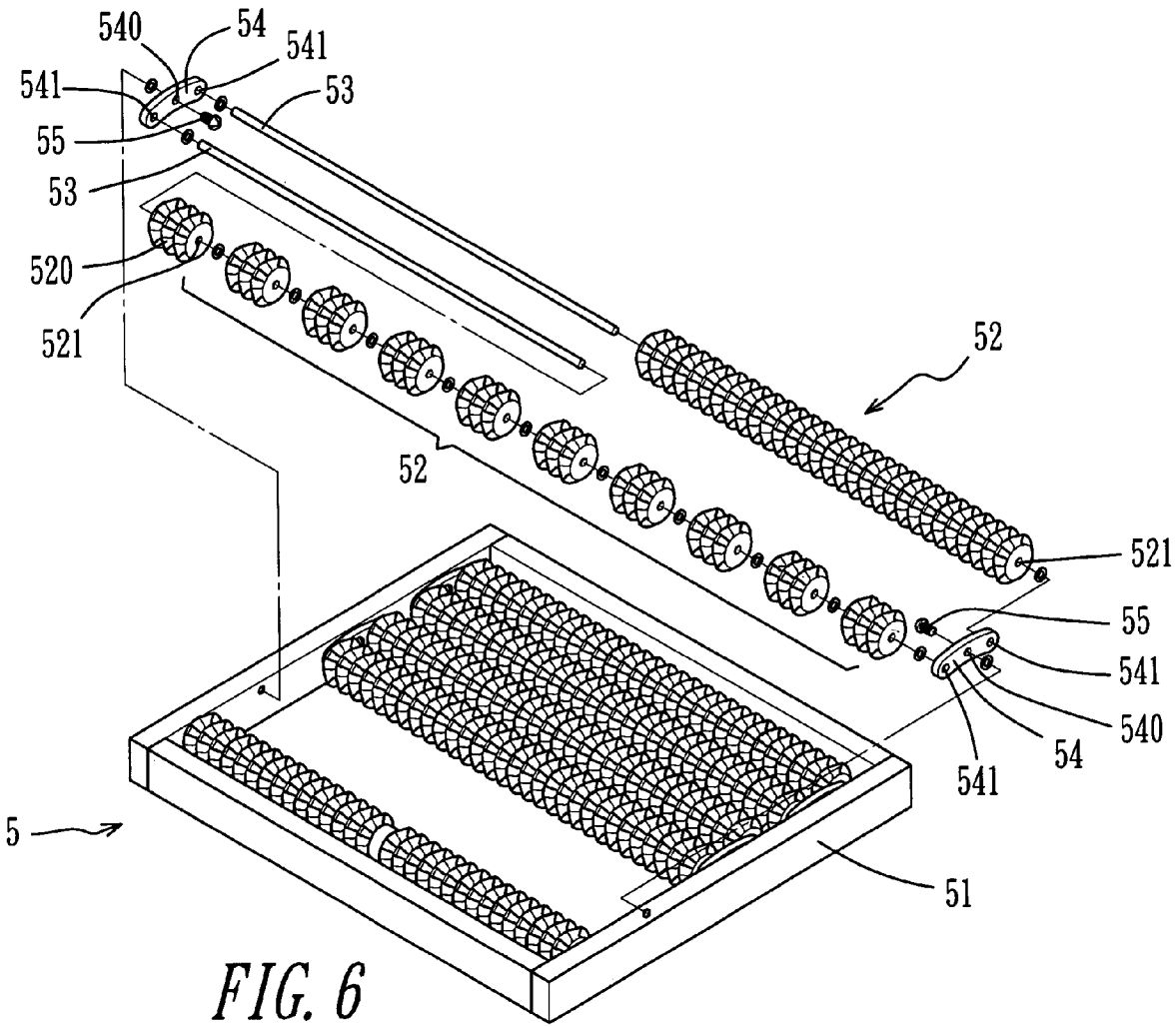
FIG. 6 is an exploded perspective view of a massage device in the first embodiment of a chair in the present invention.

A first embodiment of a chair in the present invention, as shown in FIGS. 4 and 5, includes a backrest 41 (also with a head rest), a seat 42, a massage chamber 43 and 44 respectively formed in the backrest 41 and the seat 42 for receiving a massage device 5 therein, The massage device 5, also referring to FIG. 6, is composed of a frame 51, and a massage roller unit 52 consisting of plural rows of massage rollers 520 fixed in the frame 51. The massage rollers 520 of each row respectively have a center shaft hole 521 for an elongate center shaft 53 to fit in for keeping (or stringing) the massage rollers respectively provided with a plurality of massage projections 520 spaced apart on its outer surface. Then the massage roller unit 52 can be composed of a single massage surface area (or single shaft transmitting) and double massage surface area (or two shaft transmitting) to contact the use's body, arranged in the frame 51.

Figure 7:
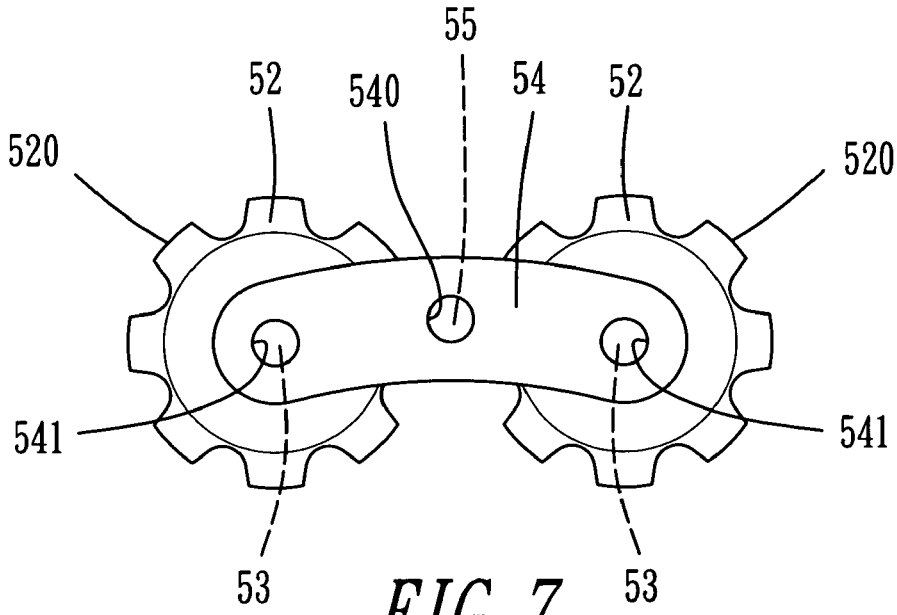
FIG. 7 is a side view of two rows of massage rollers of the massage device in the first embodiment of a chair in the present invention.
Figure 8:
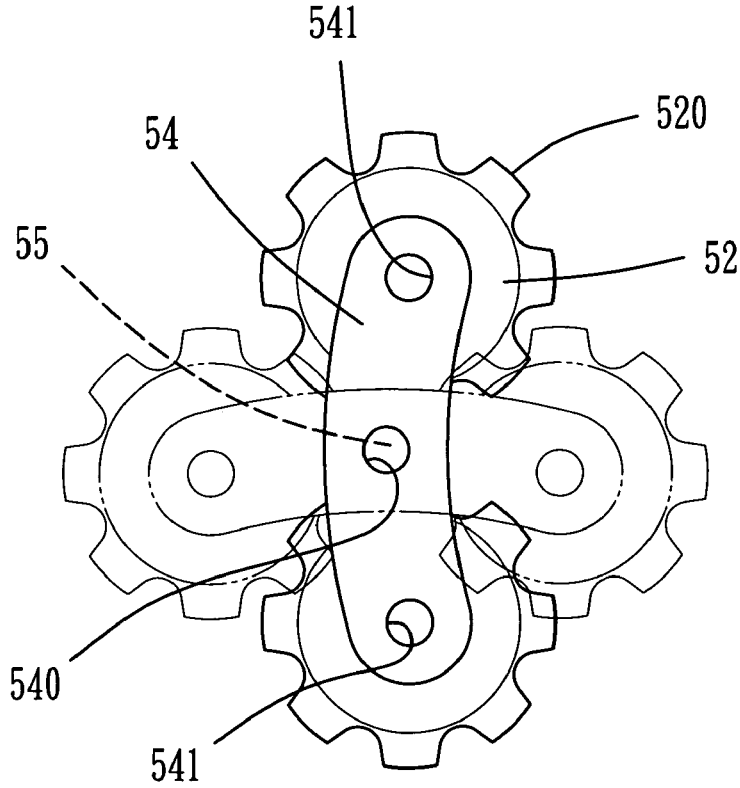
FIG. 8 is a side view of four rows of massage rollers of the massage device in the first embodiment of a chair in the present invention.
Figure 9:
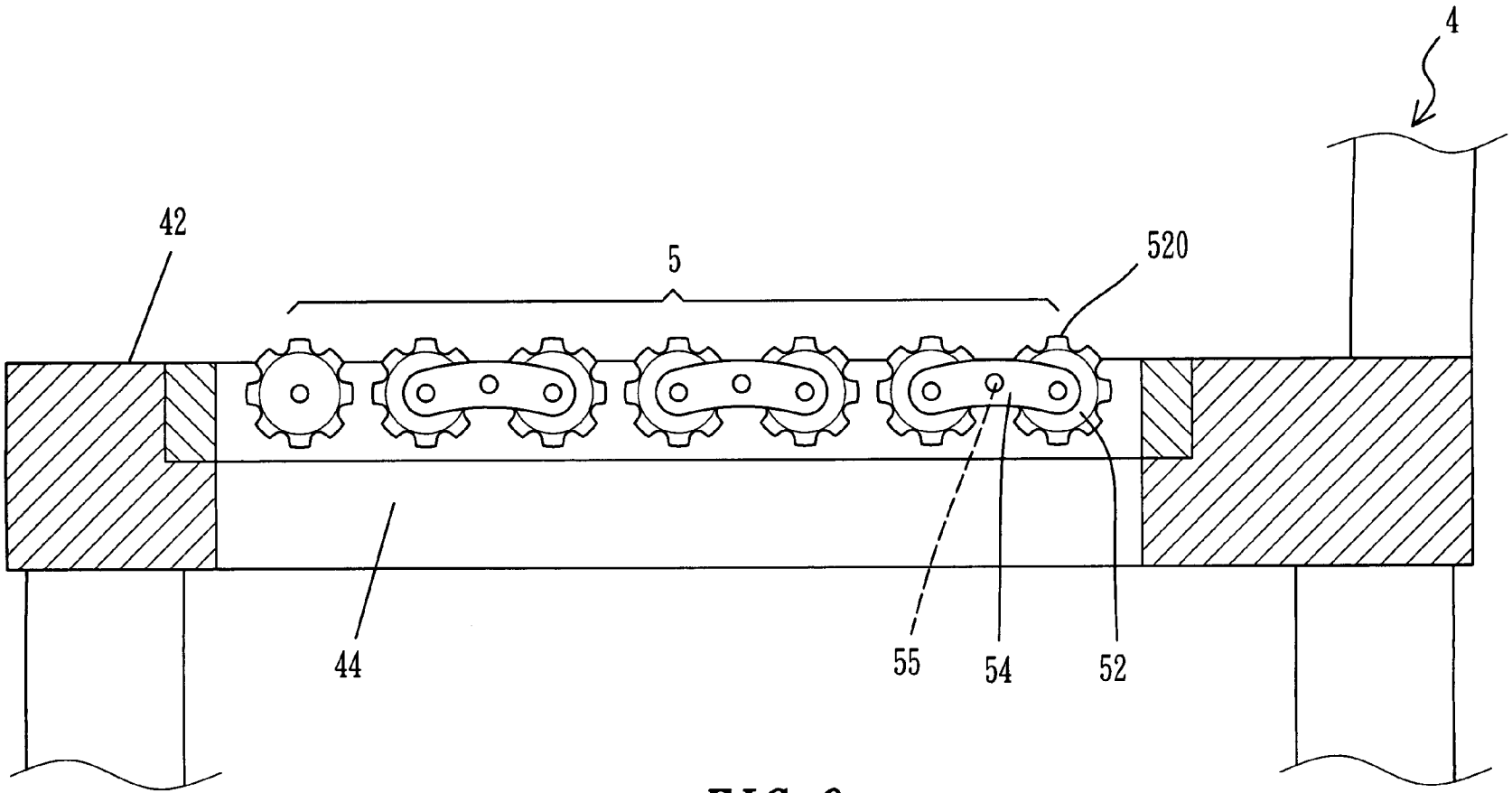
FIG. 9 is a side cross-sectional view of the massage device positioned in the seat of a chair in the present invention.
Figure 10:
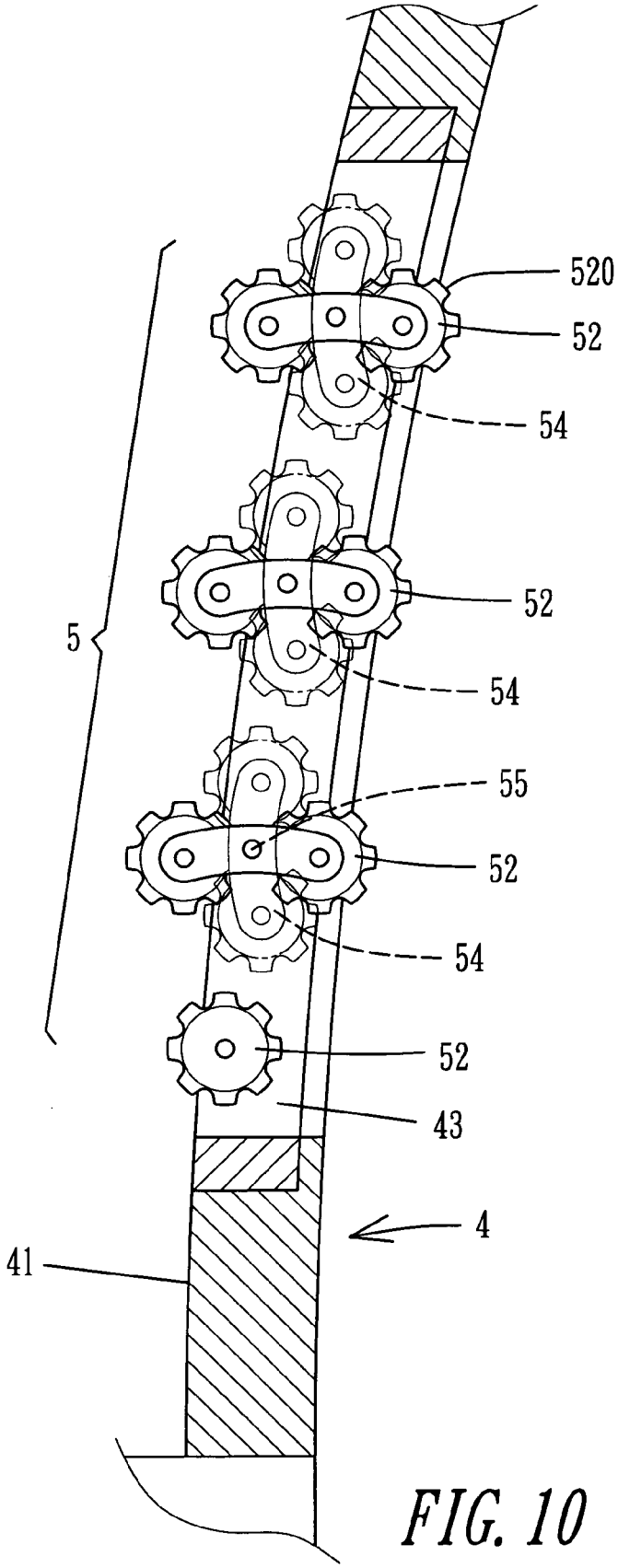
FIG. 10 is a side cross-sectional view of the massage device positioned in a backrest of a chair in the present invention.

The double massage surface area, referring to FIGS. 6 and 7, uses two independent shafts 53 for stringing the massage rollers, and two pivotal plates 54 and a center shaft 55 for supporting the massage rollers. The two pivotal plates 54 are curved a little outward, having a center shaft hole 540 for the center shaft 55 (maybe a threaded rod or any rod also usable) to fit therein, and two pivotal holes 541 bored at two sides of the center shaft hole 540 at a location little lower than the center shaft hole 540 for two ends of the independent rods 53 to fit pivotal y therein. Further, the center shaft 55 pivotally connects with the frame 51 of the massage device 5, permitting the massage roller unit 52 to rotate with the center shaft 55 as a pivot, as shown in FIG. 8. Therefore, if a user rests the bottom or the back on the massage device 5, as shown in FIGS. 9, and 10, the user's body can get massage function by shifting the body rubbingly against the massage rollers unit 52, which can also be rotated and produce massage action to the user's bottom or back with the substantial massage surface area.

Figure 11:
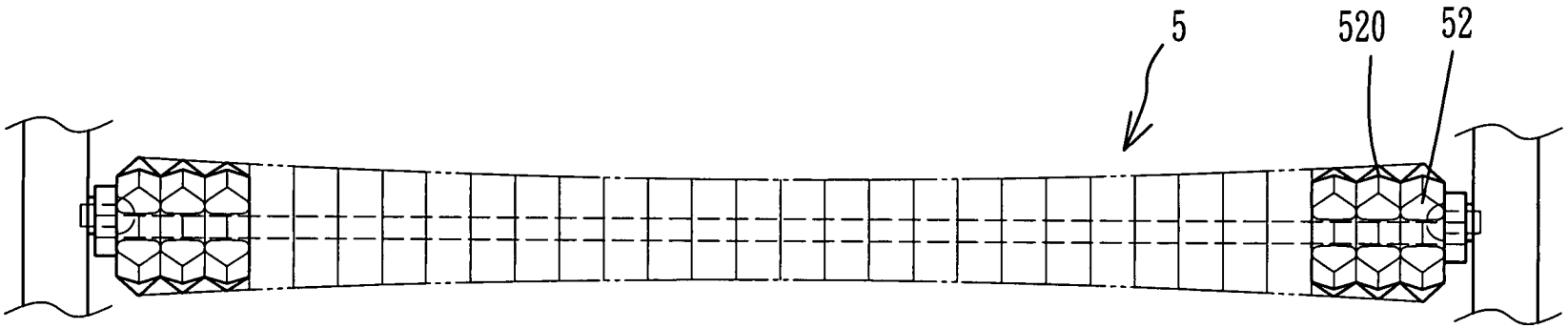
FIG. 11 is a side view of another embodiment of a massage device positioned in the seat of a chair in the present invention.

Next, as shown in FIG. 11, the massage roller unit 52 can be made to have the outermost string (or row) of the rollers with the whole outer surface formed to taper gradually from the two outer ends to the center point, or in other words, the whole massaging surface of the that string of the massage roller unit 52 formed a slow recess in the intermediate portion for a user to sit thereon so a special portion of the body may get better massage effect.

Figure 12:
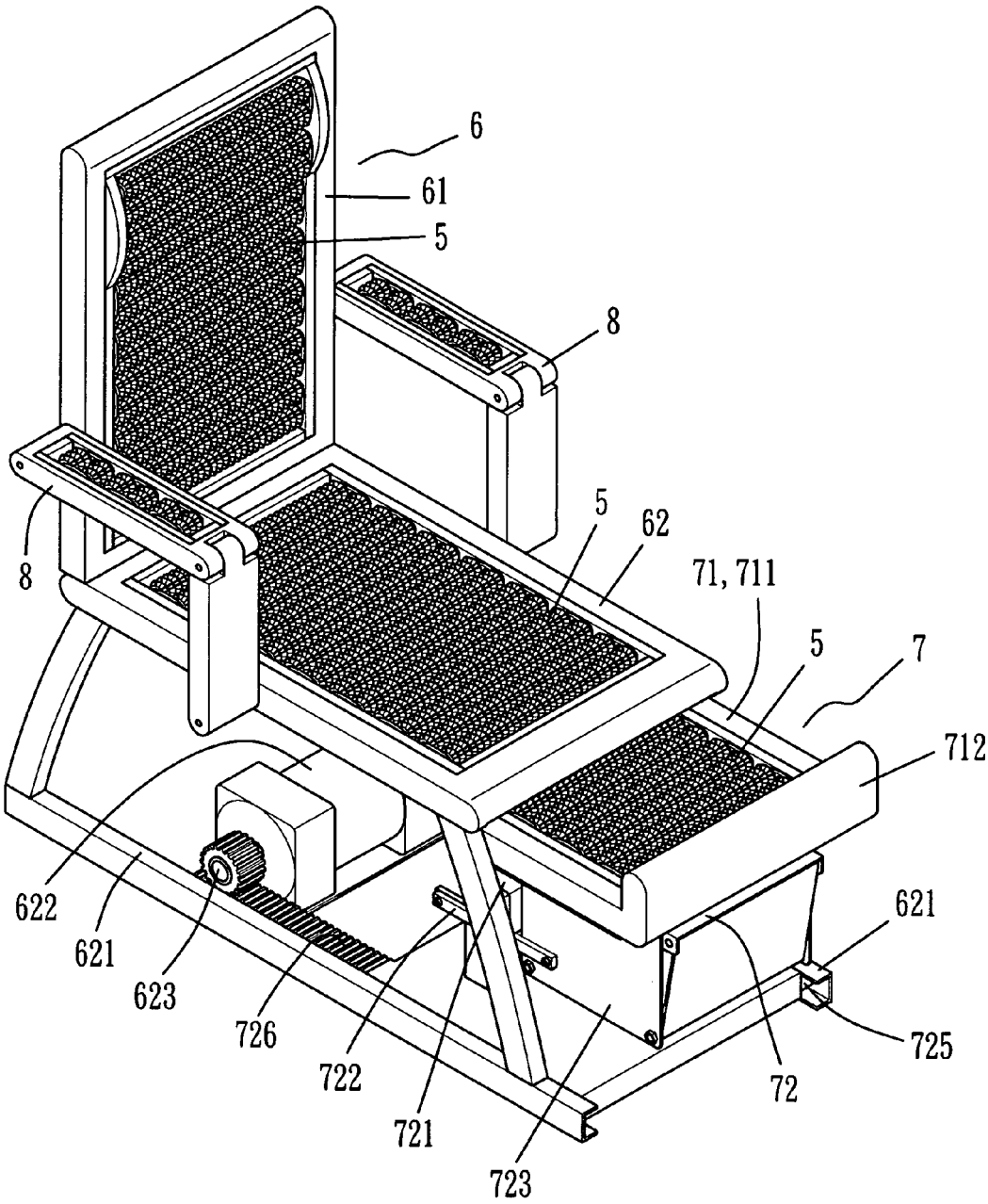
FIG. 12 is a perspective view of a second embodiment of a chair capable to lie on in the present invention.
Figure 13:
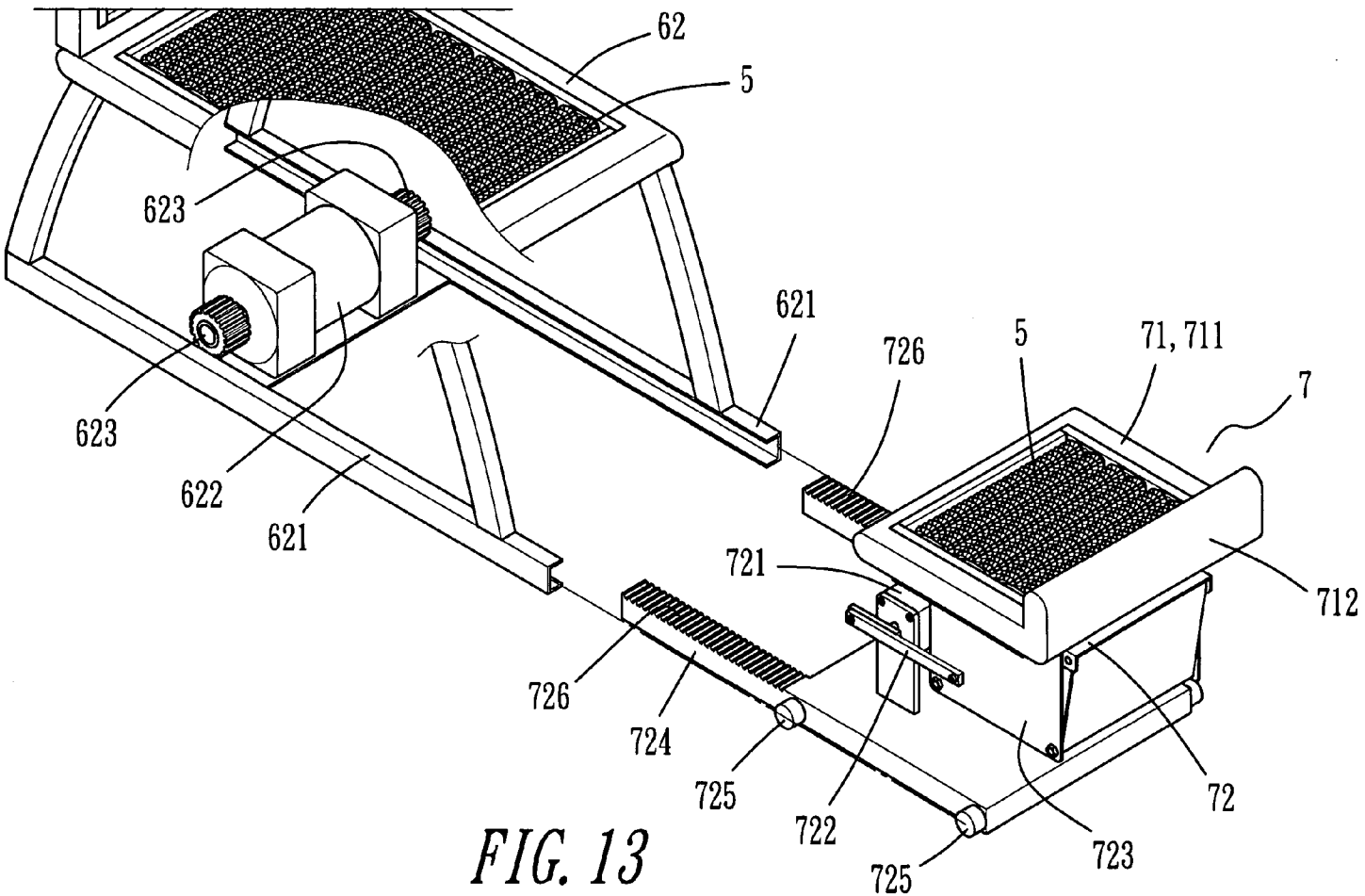
FIG. 13 is an exploded perspective view of the second embodiment of a chair shown in FIG. 12.

Further, the massage device 5 can be installed in a backrest 61 or a seat 62 of a lie-down chair 6, and a thigh rest 7 can also be added to the lie-down chair and combined under the seat 62, and at the same time two armrests 8 are possible to be pivotally connected at the two sides of the lie-down chair 6, as shown in FIGS. 12 and 13. The thigh rest 7 is composed of a thigh cushion 71 and a bottom base 72, with the massage device 5 inserted in the center portion of the thigh resting surface 711 of the thigh cushion 71, and the thigh resting surface 711 has a stop plate 712 fixed vertically projecting up on the outer end. An inverted U-shaped swing plate 723 is provided behind the bottom base 72, possible to swing forward and backward by a connect rod 722 driven by a motor 721, fixed with the bottom of the thigh cushion 71 so the thigh cushion 71 may move together, The bottom base 72 is positioned on a pair of rails 724, with rollers 725 fixed on each outer side of each rail 724 and inserted movably in a C-shaped guide rails 621 at the inner side of the bottom of the feet of the lie-down chair 6. Further, the rails 724 extend rearward and have a rack 726 respectively on its upper surface, and the racks 726 engage transmitting gears 633 at the two sides of the transmitting motor 622. The massage devices 5 can also be combined on the upper surface of the armrests 8.

Figure 14:
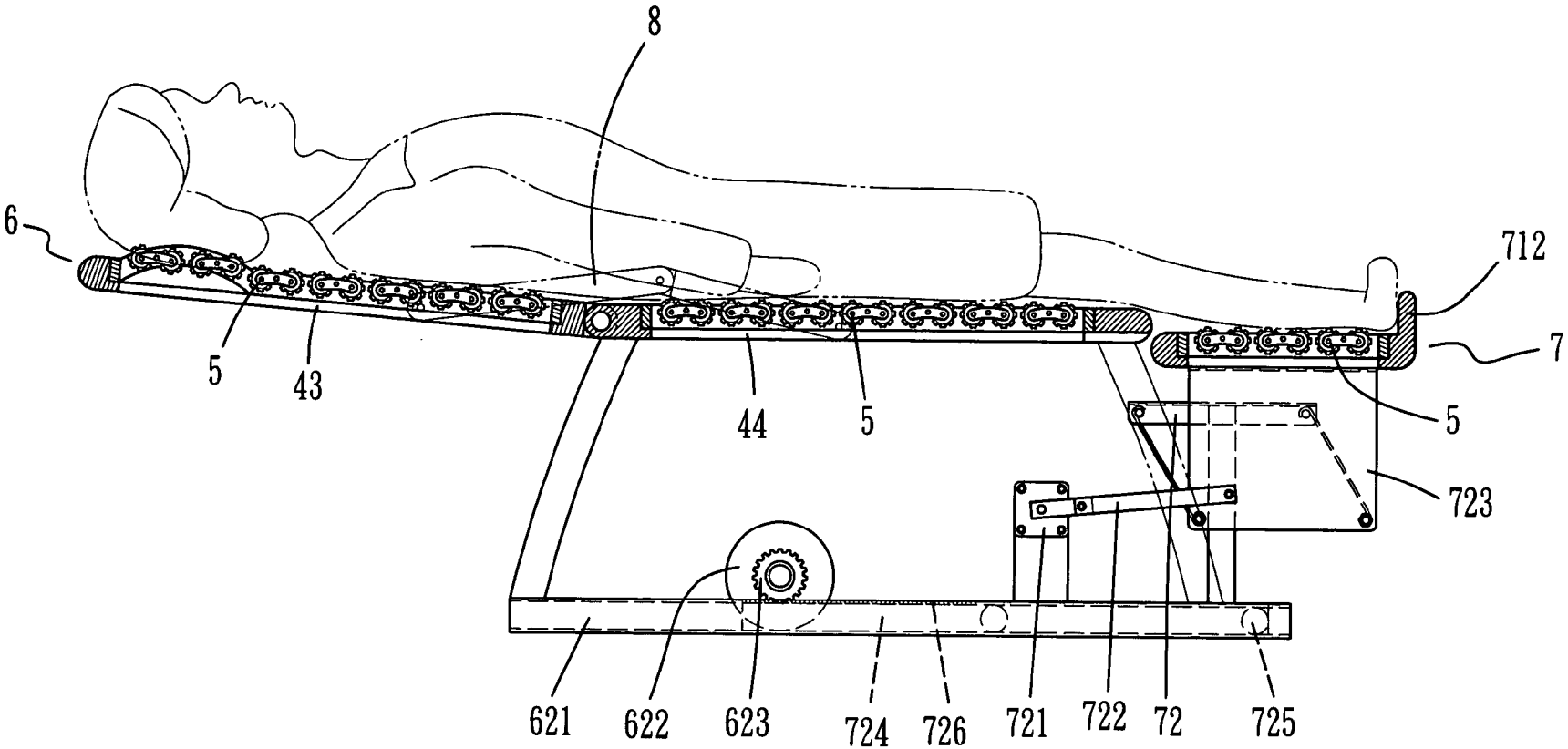
FIG. 14 is a side view of the second embodiment of a chair used as a lying chair in the present invention.
Figure 15:
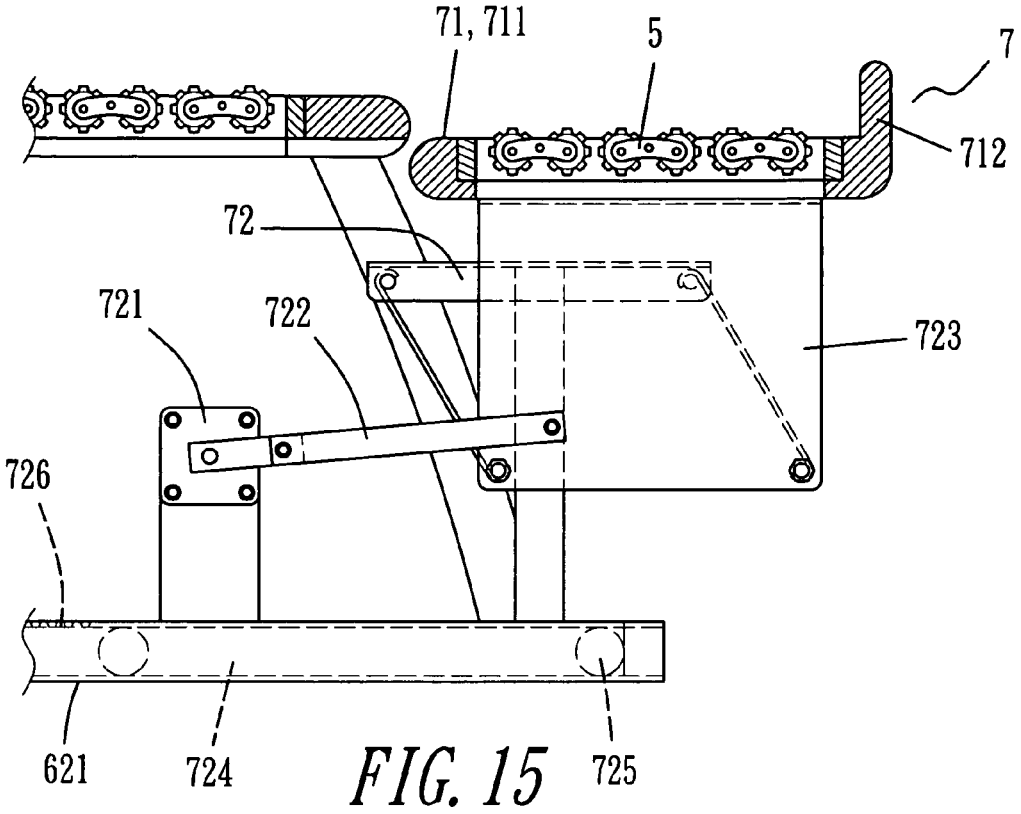
FIG. 15 is a side view of the second embodiment of a chair to be expanded in the present invention.
Figure 16:
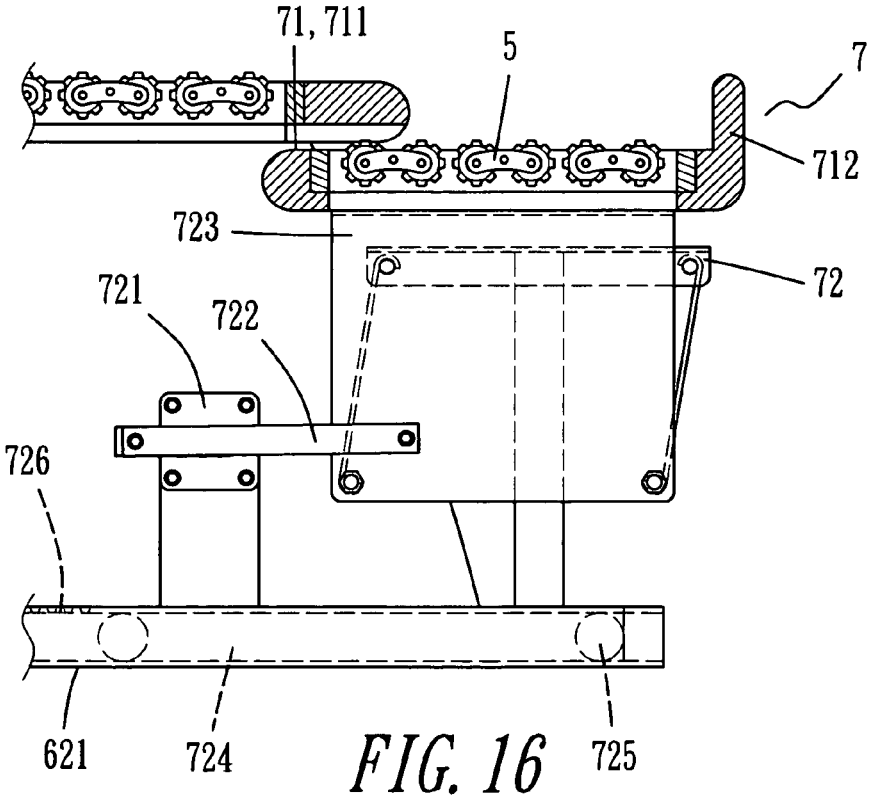
FIG. 16 is another side view of the second embodiment of a chair being collided in the present invention; and, FIG. 17 is a side view of the second embodiment of a chair with its thigh rest collapsed in the present invention.
Figure 17:
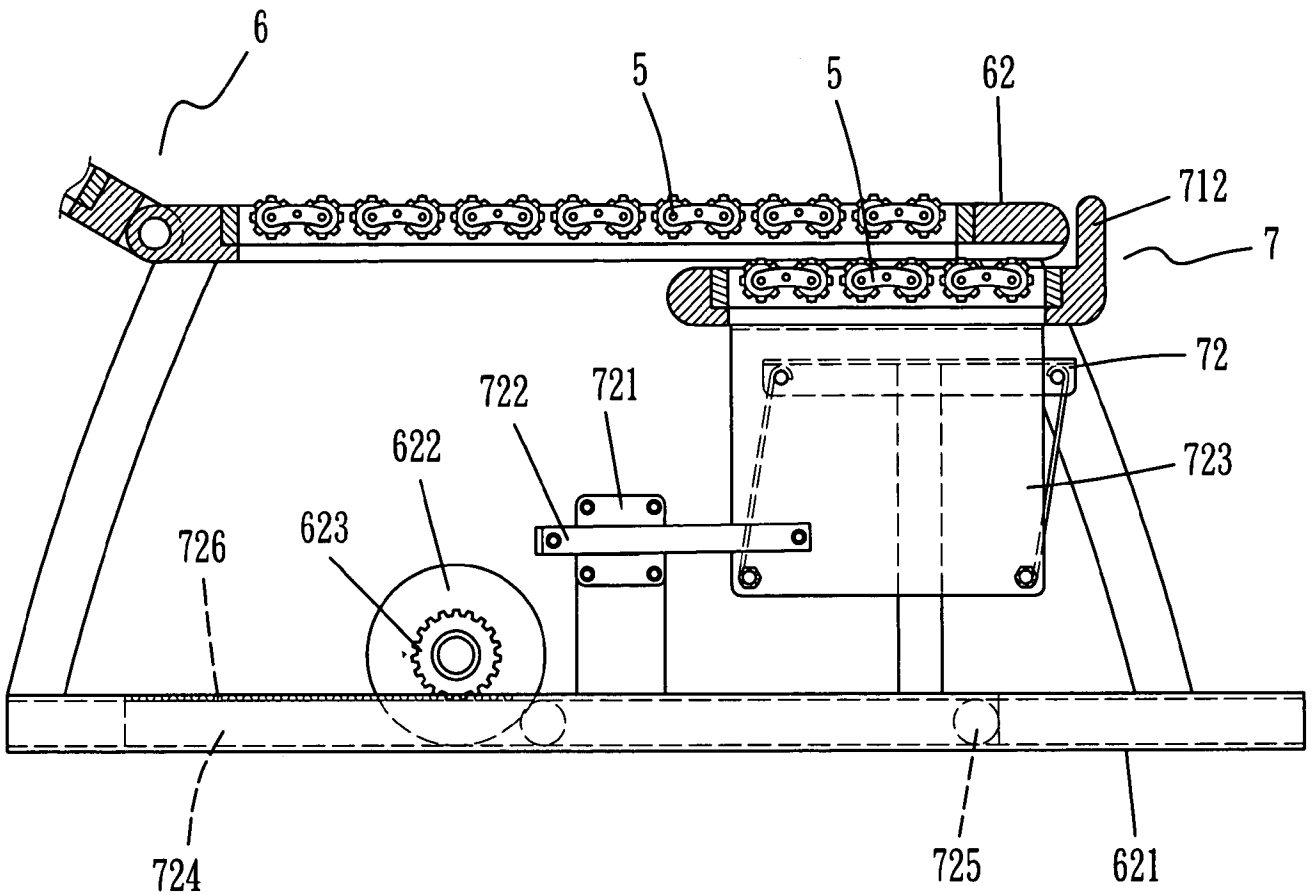

If a user uses the lie-down chair 6 shown in FIG. 14, he/she rests two arms on the armrests 8 pulled in a flat condition, starting the motor 622 below the chair 6. Then the transmitting gears 623 rotates synchronously, moving the racks 726 on the rails 724 to force the thigh rest 7 move forward along the rail 724 to the front of the seat 61 and stop in place. Next, as shown in FIG. 14, the user places two thighs on the thigh rest surface 711 of the thigh cushion 71, with the soles resting on the stop plate 712. Lastly, the motor 721 is started to move the connect rod 722 so as to move the swing plates 723 and the thigh cushion 71 to swing back and forth synchronously, as shown in FIGS. 15 and 16. In this way, the stop plate 712 reciprocates back and forth, moving the user's feet back and forth, massaging the user's body automatically so long as the user is lying on the chair 6 without need of moving. So the lie-down chair 6 is enhanced in its usefulness and convenience. And it goes without saying that the user uses no more his/her own force to get massages, After massage finished, handling the motor 622 can force the gear 623 to move the thigh rest 7 slide back under the seat 61, as shown in FIG. 17, collapsing the lie down chair 6 to a small size .

The chair according to the invention has the following advantages, as can be understood from the foresaid description.

1. The massage device attached in a chair has a simple structure, having much useful effectiveness by the massage function in addition to the original sitting function of the conventional chairs. Moreover, the chair with a massage device in the invention costs not so high, improving conventional chairs in terms of business and consumers.
2. A user can select the location of the body for massage freely, with its massage device not like traditional one by utilizing two massage surfaces (referring to FIGS. 9 and 10), and the massage surface area is increased by the massage rollers stringed in plurality and possible to be rotated with the center shaft 55 functioning as a pivot.
3. A user can be massaged automatically with no need of shifting the body, by means of the thigh rest 7 moved to reciprocate back and forth by the motor 721 and the connect rod 722 (referring to FIGS. 15 and 16), with the user's body moved back and forth for the massage device performing massaging, saving user's force and letting the user relax.

While the preferred embodiments of the invention have been described above, it will be recognized and understood that various modifications may be made therein and the appended claims are intended to cover all such modifications that may fall within the spirit and scope of the invention.

What is claimed is:

1. A chair comprising a massage device provided in a body-contacting surface, said massage device composed of a frame and a massage roller unit, said massage roller unit having plural rows of massage rollers arranged in said frame; each row of said massage rollers having plural massage rollers respectively bored with a center shaft hole for an independent shaft to extend through to string together said plural massage rollers, each said independent shaft pivotally combined in said frame of said massage device, each said string of said massage rollers forming a rotatable massage surface together with another said string of said massage rollers, each said massage surface formed with two rows of said massage rollers combined on two respective independent shafts, said two rows of the massage rollers combined with first and second pivotal plates located at and spanning across respective first and second ends of said two rows and with a center shaft; said pivotal plates respectively having a center shaft hole for said center shaft to fit pivotally therein, two pivotal holes bored at two sides of said center shaft hole and located lower than said center shaft hole for said respective independent shafts to fit pivotally therein, said center shaft pivotally connected in said frame so that said two rows of the massage rollers may rotate with the said center shaft as a pivot, each massage surface of said two rows of the massage rollers rotatable to produce a massage function against the body of a user when the user rests the body on said massage device and shifts the body.

2. The chair as claimed in claim 1, wherein the contacting surface of the chair is a head-resting surface for a user's head to rest on.

3. The chair as claimed in claim 1, wherein the contacting surface of the chair is a seat for a user's bottom to rest on.

4. The chair as claimed in claim 1, wherein the contacting surface of the chair is a backrest for a user's back to rest on.

5. The chair as claimed in claim 1, wherein the contacting surface of the chair is a thigh rest for a user's thigh to rest on.

6. The chair as claimed in claim 1, wherein the contacting surface of the chair is a armrest for a user's arm to rest on.

* * * * *